US006650046B2

(12) United States Patent
Shirakawa et al.

(10) Patent No.: US 6,650,046 B2
(45) Date of Patent: Nov. 18, 2003

(54) THIN-FILM EL DEVICE, AND ITS FABRICATION PROCESS

(75) Inventors: Yukihiko Shirakawa, Tokyo (JP); Masashi Miwa, Tokyo (JP); Katsuto Nagano, Tokyo (JP); Yoshihiko Yano, Tokyo (JP)

(73) Assignee: TDK Corporation, Tokyo (JP)

( * ) Notice: Subject to any disclaimer, the term of this patent is extended or adjusted under 35 U.S.C. 154(b) by 30 days.

(21) Appl. No.: 09/988,141

(22) Filed: Nov. 19, 2001

(65) Prior Publication Data

US 2002/0130616 A1 Sep. 19, 2002

Related U.S. Application Data

(63) Continuation-in-part of application No. 09/866,718, filed on May 30, 2001, now Pat. No. 6,577,059.

(30) Foreign Application Priority Data

Nov. 17, 2000 (JP) ..... 2000-351859

(51) Int. Cl.[7] ..... H05B 33/22

(52) U.S. Cl. ..... 313/506; 313/503; 428/917; 427/58; 427/66

(58) Field of Search ..... 313/503, 506; 428/690, 917; 315/169.3; 427/58, 66

(56) References Cited

U.S. PATENT DOCUMENTS 4,870,322 A * 9/1989 Matsudaira et al. ..... 313/506
5,336,965 A * 8/1994 Meyer et al. ..... 313/506

FOREIGN PATENT DOCUMENTS

| | | |
|---|---|---|
| JP | 61-250993 | 11/1986 |
| JP | 62-44989 | 2/1987 |
| JP | 7-50197 | 2/1995 |
| JP | 7-44072 | 5/1995 |

OTHER PUBLICATIONS

S. Tanaka, Monthly Magazine Display, pp. 1–10, "Recent Development of Inorganic and Organic EL Display", Apr. 1998.

X. Wu, International Display Workshop (IDW), pp. 593–596, "Multicolor Thin–Film Ceramic Hybrid EL Displays", 1997.

* cited by examiner

*Primary Examiner*—Ashok Patel
(74) *Attorney, Agent, or Firm*—Oblon, Spivak, McClelland, Maier & Neustadt, P.C.

(57) ABSTRACT

The invention aims to provide, without incurring any cost increase, a thin-film EL device comprising a multilayer dielectric layer formed of a lead-based dielectric material by a solution coating-and-firing process, which has solved problems including light emission luminance drops, luminance variations and changes of light emission luminance with time, thereby achieving high display quality, and a process for the fabrication of the same. The object is accomplished by forming a patterned electrode layer on an electrically insulating substrate and constructing thereon a dielectric layer having a multilayer structure wherein lead-based dielectric layers formed by repeating the solution coating-and-firing process plural times and a non-lead-based, high-permittivity dielectric layer are stacked, the uppermost surface layer of the dielectric layer having a multilayer structure being the non-lead-based, high-permittivity dielectric layer.

11 Claims, 5 Drawing Sheets

THIN-FILM EL DEVICE, AND ITS FABRICATION PROCESS

This is a continuation-in-part of application Ser. No. 09/866,718, filed May, 30, 2001, now U.S. Pat. No. 6,577,059.

BACKGROUND OF THE INVENTION

1. Technical Field

This invention relates to a thin-film EL device having at least a structure comprising an electrically insulating substrate, a patterned electrode layer on the substrate, and a dielectric layer, a light-emitting layer and a transparent electrode layer stacked on the electrode layer.

2. Background Art

EL devices are now practically used in the form of backlights for liquid crystal displays (LCDs) and watches. The EL devices work on a phenomenon in which a substance emits light at an applied electric field, viz., an electroluminescence (EL) phenomenon.

The EL devices are divided into two types: dispersion type EL devices having a structure wherein electrode layers are provided on the upper and lower sides of a dispersion of light-emitting powder in an organic material or porcelain enamel, and thin-film EL devices having a thin-film light-emitting substance sandwiched between two electrode layers and two thin-film insulators on an electrically insulating substrate. These types of EL devices are each driven in a direct or alternating voltage drive mode. Known for long, the dispersion type EL device has the advantage of ease of fabrication; however, it has only limited use on account of low luminance and short service life. On the other hand, the thin-film EL device has recently wide applications due to the advantages of high luminance and a long lifetime.

FIG. 2 shows the structure of a double-insulation type thin-film EL device typical of prior art thin-film EL devices. This thin-film EL device includes a transparent substrate 21 formed of a green glass sheet used for liquid crystal displays or PDPs, and a transparent electrode layer 22 formed of ITO or the like to a thickness of about 0.2 $\mu$m to 1 $\mu$m in a predetermined stripe pattern, a first insulator layer 23 in transparent thin-film form, a light-emitting layer 24 having a thickness of about 0.2 $\mu$m to 1 $\mu$m and a second insulator layer 25 in transparent thin-film form stacked on the substrate. Further, an electrode layer 26 is formed by patterning an Al thin-film or the like in stripes extending perpendicular to the transparent electrode layer 22. The transparent electrode layer 22 and the electrode layer 26 together define a matrix, in which voltage is selectively applied to a selected area of light-emitting substance to allow the light-emitting substance of that specific pixel to emit light. The resultant light is extracted from the substrate side. Having a function of limiting current flow through the light-emitting layer, the thin-film insulator layers are able to inhibit the dielectric breakdown of the thin-film EL device, and contribute to the achievement of stable light-emitting properties. Thus, the thin-film EL device of this structure now finds wide commercial applications.

For the aforesaid thin-film transparent insulator layers 23 and 25, transparent dielectric thin films of $Y_2O_3$, $Ta_2O_5$, $Al_3N_4$, $BaTiO_3$, etc. are formed to a thickness of about 0.1 to 1 $\mu$m by sputtering, evaporation or the like.

Among light-emitting materials, Mn-doped ZnS exhibiting yellowish orange light emission has mainly been used for ease of film formation and light-emitting properties. For color display fabrication, the use of light-emitting materials capable of emitting light in the three primary colors, red, green and blue is inevitable. These materials known so far in the art, for instance, include Ce-doped SrS and Tm-doped ZnS exhibiting blue light emission, Sm-doped ZnS and Eu-doped CaS exhibiting red light emission, and Tb-doped ZnS and Ce-doped CaS exhibiting green light emission.

The light-emitting materials disclosed in Shosaku Tanaka, "the Latest Development in Displays" in Monthly Display, April, 1998, pp. 1–10, include ZnS, Mn/CdSSe, etc. as red light-emitting materials, ZnS:TbOF, ZnS:Tb, etc. as green light-emitting materials, and SrS:Cr, $(SrS:Ce/ZnS)_n$, $Ca_2Ga_2S_4$:Ce, $Sr_2Ga_2S_4$:Ce, etc. as blue light-emitting materials. Such light-emitting materials as SrS:Ce/ZnS:Mn are also disclosed as white light-emitting materials.

International Display Workshop (IDW), 1997, X. Wu, "Multicolor Thin-Film Ceramic Hybrid EL Displays", pp. 593–596 discloses that among the aforesaid materials, SrS:Ce is used in a thin-film EL device having a blue light-emitting layer. In addition, this article discloses that when a light-emitting layer of SrS:Ce is formed, an electron beam evaporation process in a $H_2S$ atmosphere enables to form a light-emitting layer of high purity.

However, for these thin-film EL devices, a structural problem remains unsolved. The problem is that since the insulator layers are each formed of a thin film, it is difficult to reduce to nil steps at the edges of the pattern of the transparent electrode, which occur when a large area display is fabricated, and defects in the thin-film insulators, which are caused by dust, etc. occurring in the production process, resulting in a destruction of the light-emitting layer due to a local dielectric strength drop. Such defects offer a fatal problem to display devices, and become a bottleneck in the wide practical use of thin-film EL devices in a large-area display system, in contrast to liquid crystal displays or plasma displays.

To provide a solution to the defect problem with such thin-film insulators, JP-A07-50197 and JP-B07-44072 disclose a thin-film EL device using an electrically insulating ceramic substrate as a substrate and a thick-film dielectric material instead of the thin-film insulator located beneath the light-emitting substance. As shown in FIG. 3, this thin-film EL device has a structure having a lower thick-film electrode layer 32, a thick-film dielectric layer 33, a light-emitting layer 34, a thin-film insulator layer 35 and an upper transparent electrode 36 stacked on a substrate 31 such as a ceramic substrate. Unlike the thin-film EL device shown in FIG. 2, the transparent electrode layer is formed at the top of the device because the light emitted from the light-emitting substance is extracted out of the upper side of the device facing away from the substrate.

The thick-film dielectric layer in this thin-film EL device has a thickness of several tens of nanometers to several hundreds of microns that is several hundred to several thousand times as thick as the thin-film insulator layer. Thus, the thin-film EL device has the advantages of high reliability and high fabrication yields because of little dielectric breakdown caused by pinholes formed by steps at electrode edges or dust, etc. occurring in the device fabrication process. Although the use of this thick- film dielectric layer leads to a problem that the effective voltage applied to the light-emitting layer drops, this problem can be solved or eliminated by using a high permittivity material for the dielectric layer.

However, the light-emitting layer formed on the thick-film dielectric layer has a thickness of barely several hundreds of nanometers that is about 1/100 of that of the thick-film dielectric layer. For this reason, the thick-film dielectric layer must have a smooth surface at a level less than the thickness of the light-emitting layer. However, it is still difficult to sufficiently smooth down the surface of a dielectric layer fabricated by an ordinary thick-film process.

To be more specific, a thick-film dielectric layer, because of being essentially constructed of ceramics using a powdery material, usually suffers a volume shrinkage of about 30 to 40% upon dense sintering. However, ordinary ceramics are consolidated through a three-dimensional shrinkage upon sintering whereas a thick-film ceramic material formed on a substrate does not shrink across the substrate because the thick film is constrained to the substrate; its volume shrinkage occurs only in the thickness direction or one-dimensionally. For this reason, the sintering of the thick-film dielectric layer does not proceed to a sufficient extent, yielding an essentially porous layer.

Since the consolidation process proceeds through a solid phase reaction of ceramic powder having a certain particle size distribution, abnormally sintered sites such as abnormal crystal grain growth and macropores are likely to occur. In addition, the surface roughness of the thick film is absolutely greater than the crystal grain size of polycrystalline sintered body, and accordingly, the thick film has surface asperities of at least submicron size even in the absence of such defects as mentioned above.

When the dielectric layer has surface defects or a porous structure or asperity shape as mentioned above, it is impossible to deposit thereon a uniform light-emitting layer by evaporation, sputtering or the like because the light-emitting layer is conformal to the surface shape of the dielectric layer. This results in problems such as a decrease in effective light-emitting area because an electric field cannot be effectively applied to the portions of the light-emitting layer formed on non-flat portions of the substrate, and a decrease in light emission luminance because local non-uniformity of thickness causes a local dielectric breakdown of the light-emitting layer. Furthermore, locally large thickness fluctuations cause the strength of an electric field applied to the light-emitting layer to locally vary too largely to obtain any definite light emission voltage threshold.

Thus, conventional fabrication processes needed operations of polishing down large surface asperities of a thick-film dielectric layer and then removing finer asperities by a sol-gel step.

However, the polishing of a large-area substrate for display or other purposes is technically difficult to achieve, and is a factor for cost increases. The addition of the sol-gel step is another factor for cost increases. When a thick-film dielectric layer has abnormally sintered sites which may give rise to asperities too large for removal by polishing, they cannot be removed even by the addition of the sol-gel step, which causes a drop of manufacturing yield. It is thus very difficult to use a thick-film dielectric material to form a light emission defect-free dielectric layer at low cost.

A thick-film dielectric layer is formed by a ceramic powder material sintering process where a high firing temperature is needed. As is the case with ordinary ceramics, a firing temperature of at least 800° C. and usually 850° C. is needed. To obtain a dense thick-film sintered body in particular, a firing temperature of at least 900° C. is needed. In consideration of heat resistance and a reactivity problem with respect to the dielectric layer, the substrate used for the formation of such a thick-film dielectric layer is limited to alumina or zirconia ceramic substrate; it is difficult to rely on inexpensive glass substrates. The requisite for the ceramic substrate to be used for display purposes is that it has a large area and satisfactory smoothness. The substrate meeting such conditions is obtained only with much technical difficulty, and is yet another factor for cost increases.

For the metal film used as the lower electrode layer, its heat resistance requires to use expensive noble metals such as palladium and platinum. This, too, is a factor for cost increases.

In order to solve such problems, the inventor proposed in Japanese Patent Application No. 2000-299352 to form a multilayer dielectric layer thicker than a conventional thin-film dielectric layer, by repeating the solution coating-and-firing process plural times, for use in place of a conventional thick-film dielectric material or a thin-film dielectric material formed by a sputtering process or the like.

FIG. 4 shows the structure of a thin-film EL device using the aforesaid multilayer dielectric layer. In this thin-film EL device, a lower electrode layer 42 having a predetermined pattern is stacked on an electrically insulating substrate 41. A multilayer dielectric layer 43 is formed on the lower electrode layer by repeating the solution coating-and-firing process plural times. Further a light-emitting layer 44 and preferably a thin-film insulator layer 45 and a transparent electrode layer 46 are stacked on the dielectric layer.

As compared with a conventional thin-film dielectric layer, the multilayer dielectric layer having such structure is characterized in that high dielectric strength is achievable, locally defective insulation due to dust or the like occurring during the process is effectively prevented, and much improved surface flatness is obtainable. For a thin-film EL device using the aforesaid multilayer dielectric layer, glass substrates less expensive than ceramic substrates may be used because the dielectric layer can be formed at a temperature lower than 700° C.

However, when the multilayer dielectric layer is formed by a solution coating-and-firing process, using a lead-based dielectric material as the dielectric layer material, a light-emitting layer to be formed on the dielectric layer can react with the lead component of the dielectric layer, giving rise to some practically unfavorable problems such as initial light emission luminance drops, luminance variations, and changes of light emission luminance with time

SUMMARY OF THE INVENTION

An object of the present invention is to provide, without incurring any cost increase, a thin-film EL device which eliminates any restriction on the selection of substrates—that is one problem associated with a conventional thin-film EL device—so that glass and similar substrates which are inexpensive and easy to form to a large area can be used, and enables non-flat portions of a dielectric layer due to an electrode layer or dust or the like during processing to be corrected by a quick-and-easy process and the dielectric layer to have improved surface flatness. Especially when the invention is applied to a thin-film EL device having a multilayer dielectric layer formed using a lead-based dielectric material as mentioned above, high display qualities can be obtained with no light emission luminance drop, no luminance variation, and no change of light emission luminance with time. Another object of the present invention is to provide a process for fabricating the thin-film EL device.

The above objects are achieved by the following embodiments of the invention.

(1) A thin-film EL device having at least a structure comprising an electrically insulating substrate, a patterned lower electrode layer stacked on said substrate, and a dielectric layer, a light-emitting layer and an upper electrode layer stacked on said lower electrode layer, at least one of said lower electrode and said upper electrode being a transparent electrode, wherein said dielectric layer has a multilayer structure wherein lead-based dielectric layers formed by repeating a solution coating-and-firing process plural times and a non-lead-based, high-permittivity dielectric layer are stacked, and an uppermost surface layer of said dielectric layer having a multilayer structure is the non-lead-based, high-permittivity dielectric layer.

(2) The thin-film EL device of (1), wherein said lead-based dielectric layer has a thickness of 4 $\mu$m to 16 $\mu$m inclusive.

(3) The thin-film EL device of (1), wherein said non-lead-based dielectric layer has a thickness of more than 0.2 $\mu$m.

(4) The thin-film EL device of any one of (1) to (3), wherein said non-lead-based, high-permittivity dielectric layer is made of a perovskite structure dielectric material.

(5) The thin-film EL device of any one of (1) to (4), wherein said non-lead-based, high-permittivity dielectric layer is formed by a sputtering process.

(6) The thin-film EL device of any one of (1) to (4), wherein said non-lead-based, high-permittivity dielectric layer is formed by the solution coating-and-firing process.

(7) The thin-film EL device of (6), wherein said dielectric layer having a multilayer structure is formed by repeating the solution coating-and-firing process at least three times.

(8) A process for fabricating a thin-film EL device having at least a structure comprising an electrically insulating substrate, a patterned lower electrode layer stacked on said substrate, and a dielectric layer, a light-emitting layer and an upper electrode layer stacked on said lower electrode layer, at least one of said lower electrode and said upper electrode being a transparent electrode, said process comprising the step of:

stacking lead-based dielectric layers formed by repeating a solution coating-and-firing process plural times and a non-lead-based, high-permittivity dielectric layer to form a multilayer structure such that an uppermost surface layer of the dielectric layer having the multilayer structure is the non-lead-based, high-permittivity dielectric layer.

(9) The thin-film EL device fabrication process of (8), wherein said non-lead-based, high-permittivity dielectric layer is formed by a sputtering process.

(10) The thin-film EL device fabrication process of (8), wherein said non-lead-based, high-permittivity dielectric layer is formed by the solution coating-and-firing process.

(11) The thin-film EL device fabrication process of (10), wherein said dielectric layer having the multilayer structure is formed by repeating the solution coating-and-firing process at least three times.

DESCRIPTION OF THE PREFERRED EMBODIMENTS

The thin-film EL device of the invention has at least a structure comprising an electrically insulating substrate, a patterned lower electrode layer stacked on the substrate, and a dielectric layer, a light-emitting layer and an upper electrode layer stacked on the lower electrode layer. At least one of the lower electrode and the upper electrode is a transparent electrode. The dielectric layer has a multilayer structure wherein lead-based dielectric layers formed by repeating a solution coating-and-firing process plural times and a non-lead-based, high-permittivity dielectric layer(s) are stacked together. The uppermost surface layer of the dielectric layer having a multilayer structure is the non-lead-based, high-permittivity dielectric layer. As used herein, the "lead-based dielectric layer" refers to a dielectric material containing lead in its composition, and the "non-lead-based, (high-permittivity) dielectric layer" refers to a dielectric material containing no lead in its composition.

Figure 1:
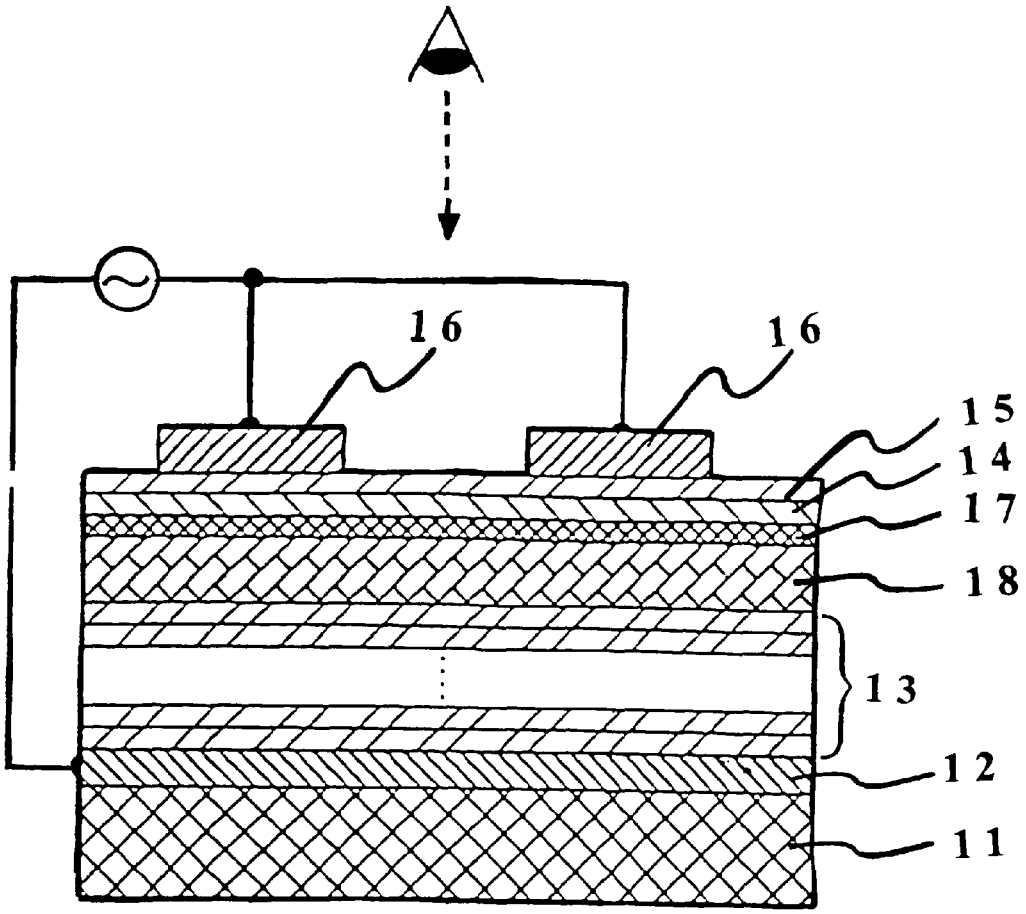
FIG. 1 is a sectional view illustrative of the structure of the thin-film EL device of the invention.
Figure 2:
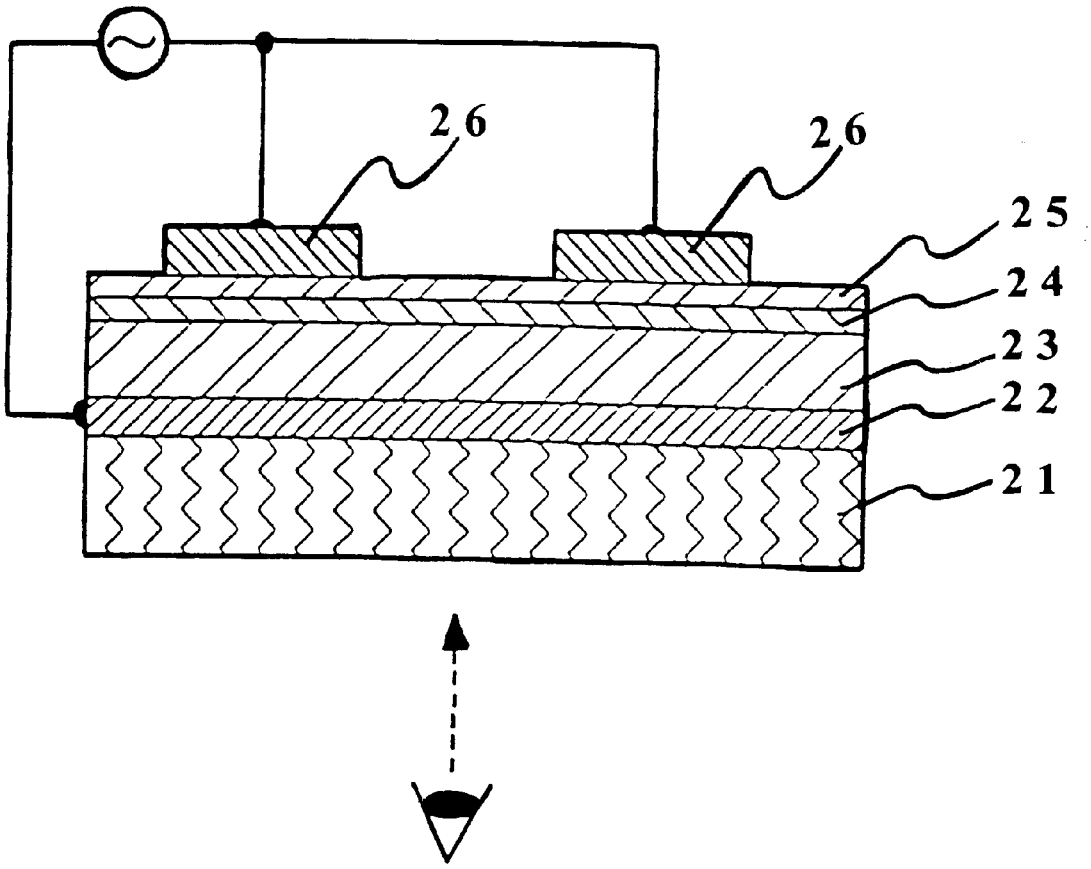
FIG. 2 PRIOR ART
FIG. 2 is a section view illustrative of the structure of a conventional thin-film EL device.
Figure 3:
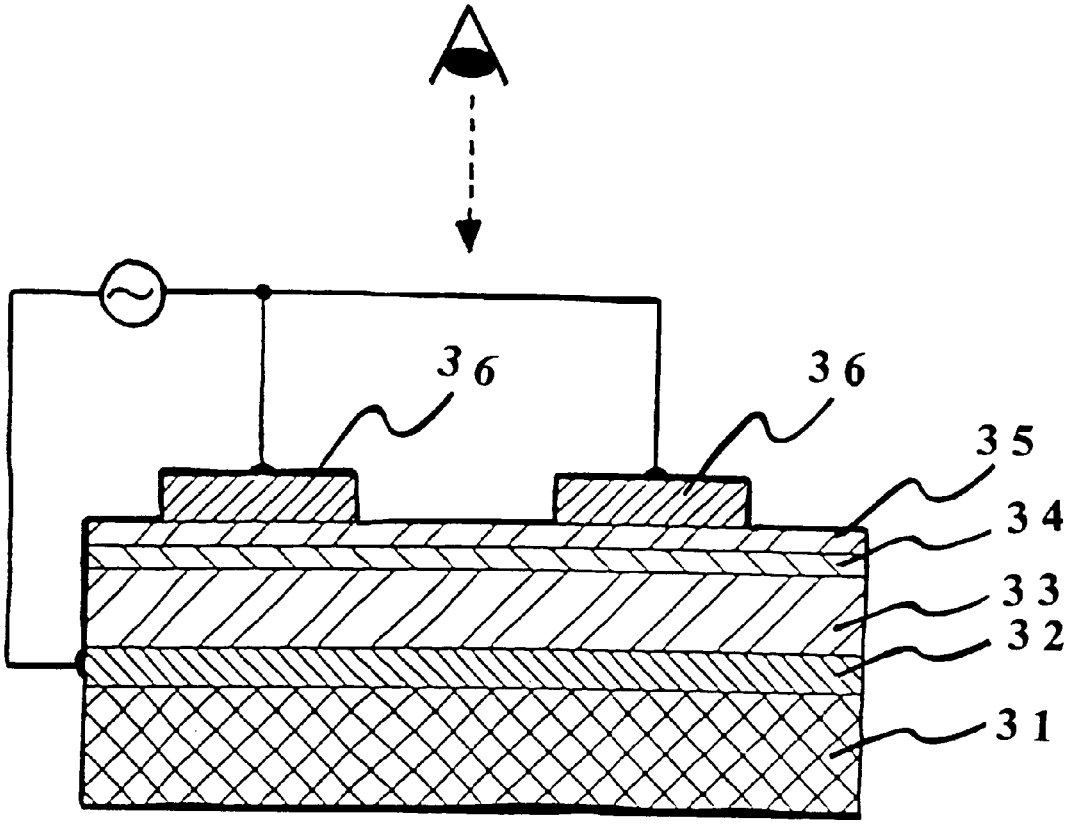
FIG. 3 PRIOR ART
FIG. 3 is a section view illustrative of the structure of another conventional thin-film EL device.
Figure 4:
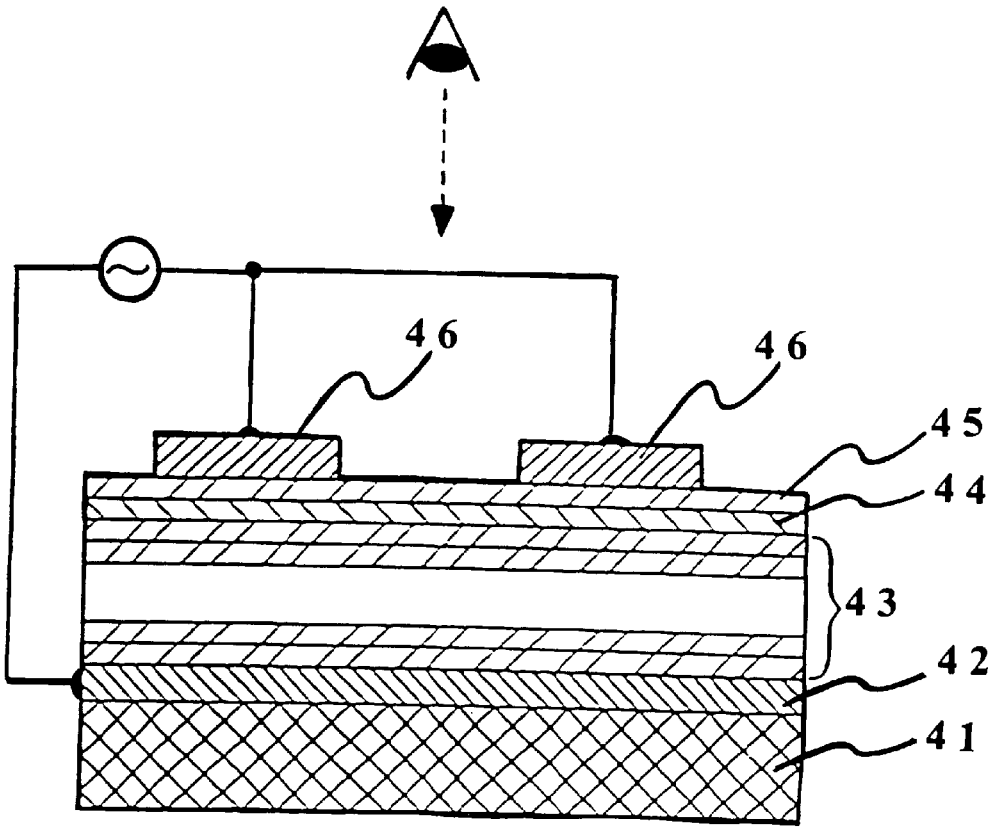
FIG. 4 PRIOR ART
FIG. 4 is a section view illustrative of the structure of yet another conventional thin-film EL device.

FIG. 1 is illustrative of the structure of the thin-film EL device according to the invention. The thin-film EL device of the invention comprises an electrically insulating substrate 11, a lower electrode layer 12 having a predetermined pattern on the substrate 11, and a multilayer dielectric layer stacked on the lower electrode layer, wherein lead-based dielectric layers 13 formed by repeating the solution coating-and-firing process plural times and a non-lead-based, high-permittivity dielectric layer 18 are stacked together in such a way that the uppermost surface layer of the dielectric layer is the non-lead-based, high-permittivity dielectric layer. Stacked on the dielectric layer are an insulator layer 17, a light-emitting layer 14, a thin-film insulator layer 15 and a transparent electrode layer 16. It is noted that the insulator layers 17 and 15 may be omitted. The lower electrode layer and the upper transparent electrode layer are each configured in stripes, which extend in orthogonal directions. The lower electrode layer and upper transparent electrode layer are respectively selected and voltage is selectively applied to the light-emitting layer at the sites where the electrodes intersect with each other, whereby the selected pixels produce light emission.

For the substrate, any desired material may be used provided that it has electrical insulating properties, does not contaminate the lower electrode layer and dielectric layer formed thereon, and maintains predetermined heat-resistant strength.

Exemplary substrates are ceramic substrates such as alumina ($Al_2O_3$), quartz glass ($SiO_2$), magnesia (MgO), forsterite ($2MgO \cdot SiO_2$), steatite ($MgO \cdot SiO_2$), mullite ($3Al_2O_3 \cdot 2SiO_2$), beryllia (BeO), zirconia ($ZrO_2$), aluminum nitride (AlN), silicon nitride (SiN) and silicon carbide (SiC), and glass substrates such as crystallized glass, high heat-resistance glass and green sheet glass substrates. Enameled metal substrates may also be used.

Of these substrates, particular preference is given to crystallized glass and high heat-resistance glass substrates as well as green sheet glass substrates on condition that they are compatible with the firing temperature for the dielectric layer to be formed thereon due to their low cost, surface properties, flatness and ease of large-area substrate fabrication.

The lower electrode layer is configured in such a way as to have a pattern comprising a plurality of stripes. Since the line width defines the width of one pixel and the space between lines defines a non-light emission area, it is desired that the space between lines be reduced as much as possible.

Although depending on the end display resolution, for instance, a line width of 200 to 500 $\mu$m and a space of about 20 $\mu$m are needed.

The lower electrode layer should preferably be formed of a material which ensures high electrical conductivity, receives no damage during dielectric layer formation, and has a low reactivity with the dielectric layer or light-emitting layer. Desired for such a lower electrode layer material are noble metals such as Au, Pt, Pd, Jr and Ag, noble metal alloys such as Au—Pd, Au—Pt, Ag—Pd and Ag—Pt, and electrode materials composed mainly of noble metals with base metal elements added thereto such as Ag—Pd—Cu, because oxidation resistance with respect to an oxidizing atmosphere used for the firing of the dielectric layer material can be easily obtained. Use may also be made of oxide conductive materials such as ITO, $SnO_2$ (Nesa film) and ZnO—Al. Alternatively, base metals such as Ni and Cu may be used as long as the firing of the dielectric layer is carried out at a partial pressure of oxygen at which these base metals are not oxidized. The lower electrode layer may be formed by known techniques such as sputtering, evaporation, and plating processes.

The dielectric layer should preferably be constructed of a material having a high permittivity and high dielectric strength. Here let e1 and e2 stand for the relative permittivities of the dielectric layer and light-emitting layer, respectively, and d1 and d2 represent the thicknesses thereof. When a voltage Vo is applied between the upper electrode layer and the lower electrode layer, the voltage V2 applied across the light-emitting layer is then given by $$V2/Vo=(e1\times d2)/(e1\times d2+e2\times d1) \quad (1)$$

Here the relative permittivity and thickness of the light-emitting layer are assumed to be e2=10 and d2=1 $\mu$m. Then, $$V2/Vo=e1/(e1+10\times d1) \quad (2)$$

The voltage effectively applied across the light-emitting layer should be at least 50%, preferably at least 80%, and more preferably at least 90% of the applied voltage. From the aforesaid expressions, it is thus found that:

$$\text{for at least 50\%, } e1\geqq 10\times d1 \quad (3)$$

$$\text{for at least 80\%, } e1\geqq 40\times d1 \quad (4)$$

$$\text{for at least 90\%, } e1\geqq 90\times d1 \quad (5)$$

In other words, the relative permittivity of the dielectric layer should be at least 10 times, preferably at least 40 times, and more preferably at least 90 times as large as the thickness of the dielectric layer as expressed in $\mu$m. For instance, if the thickness of the dielectric layer is 5 $\mu$m, its relative permittivity should be at least 50, preferably at least 200, and more preferably at least 450.

For such a high-permittivity material, various materials may occur to those skilled in the art. However, preference is given to (ferroelectric) dielectric materials containing lead as an constituent element because of their ease of synthesis and low-temperature formation capability. For instance, use is made of perovskite structure dielectric materials such as $PbTiO_3$ and PZT (=$Pb(Zr_xTi_{1-x})O_3$), and PLZT, composite perovskite-relaxor ferroelectric materials represented by $Pb(Mg_{1/3}Ni_{2/3})O_3$ or the like, and tungsten bronze ferroelectric materials represented by $PbNbO_6$ or the like. Among others, preference is given to ferroelectric materials having perovskite structures such as PZT and PLZT, because they have a high relative permittivity and are easily synthesized at relatively low temperatures due to the fact that the main constituent element lead oxide has a relatively low melting point of 890° C.

The aforesaid dielectric layer is formed by solution coating-and-firing processes such a sol-gel process and an MOD process. Generally, the sol-gel process refers to a film formation process wherein a predetermined amount of water is added to a metal alkoxide dissolved in a solvent for hydrolysis and polycondensation reaction, and the resultant precursor solution of a sol having a M—O—M bond is coated and fired on a substrate. The MOD (metallo-organic decomposition) process refers to a film formation process wherein a metal salt of carboxylic acid having an M—O bond, etc. is dissolved in an organic solvent to prepare a precursor solution, and the precursor solution is coated and fired on a substrate. The precursor solution herein used is understood to mean a solution containing an intermediate compound that is produced by dissolving a source compound in a solvent, in the film formation process such as the sol-gel or MOD process.

Generally, the sol-gel and MOD processes are used in combination, rather than used as perfectly separate processes. For instance, when a PZT film is formed, a solution is generally adjusted using lead acetate as a Pb source and alkoxides as Ti and Zr sources. In some cases, two such sol-gel and MOD processes are collectively called the sol-gel process. In the present disclosure, either process is referred to as the solution coating-and-firing process because a film is formed by coating and firing the precursor solution on a substrate. It is here noted that the dielectric precursor solution used herein includes even a solution of submicron dielectric particles mixed with the precursor solution, and the solution coating-and-firing process used herein includes even a process wherein that solution is coated and fired on a substrate.

The solution coating-and-firing process, whether it is the sol-gel process or the MOD process, enables a dielectric material to be synthesized at a temperature much lower than that used for a method making essential use of the sintering of ceramic powders as in the case of forming a dielectric material by a thick-film process, because the dielectric-forming elements are uniformly mixed on the order of submicron or lower.

Taking PZT as an example, a high temperature of 900 to 1,000° C. or higher is needed for ordinary ceramic powder sintering processes; however, use of the solution coating-and-firing process enables to form a film at a low temperature of about 500 to 700° C.

Thus, the formation of the dielectric layer by the solution coating-and-firing process makes it possible to use high heat-resistance glass, crystallized glass, green sheet glass or the like which could not be used with conventional thick-film processes in view of heat resistance.

For the synthesis of lead-based dielectric ceramics, it is required to use the starting composition containing lead in excess, as widely known in the art. To form a uniform lead-based dielectric material having satisfactory dielectric properties at low temperature using such a solution coating-and-firing process, an excess (of the order of a few % to 20%) of the lead component must be added to ceramics, as well known in the art.

In the case of the solution coating-and-firing process, the larger excess lead component is needed for prevention of reduced crystal growth due to the evaporation of the lead component during firing and the resulting lead deficiency as well as for the following possible reasons. Excessive lead of the lead component forms a low-melting composition portion which facilitates the diffusion of substance during crystal growth and makes reactions at low temperature possible; reactions occurring at temperatures lower than those for ordinary ceramics make an excessive lead component likely to be more entrapped in grown dielectric crystal grains as compared with ceramics; much more lead component is needed to maintain a sufficiently excessive lead state at each crystal growing site because the distance of diffusion of the excessive lead component is short; and so on.

The dielectric layer made up of the lead-based dielectric material to which the lead component is added in excess for such reasons is characterized in that it contains, in addition to the lead content incorporated in the crystal structure, a large excessive lead component in the state of lead oxide.

Such an excessive lead component precipitates easily from within the dielectric layer under thermal loads after the formation of the dielectric layer, especially thermal loads in a reducing atmosphere. Especially under the thermal loads in a reducing atmosphere, metallic lead is likely to occur due to the reduction of lead oxide. If a light-emitting layer as mentioned later is formed directly on this dielectric layer, there would then be light emission luminance drops and considerable adverse influences on long-term reliability through the reaction of the light-emitting layer with the lead component and contamination of the light-emitting layer with movable metal lead ions.

In particular, the metal lead ions have high migration capability, and behave as movable ions in the light-emitting layer to which high electric fields are applied, producing some considerable influences on light emission properties and, hence, especially increased influences on long-term reliability.

Even when lead oxide is not reduced to metal lead by the reducing atmosphere in particular, the incorporation of the lead oxide component in the light-emitting layer causes lead oxide to be reduced by electron bombardments due to high electric fields within the light-emitting layer with the result that the released metal ions have an adverse influence on reliability.

In addition to the lead-based dielectric layer formed by repeating the solution coating-and-firing process plural times, the thin-film EL device of the invention comprises a non-lead-based, high-permittivity dielectric layer at least on its uppermost surface layer.

This non-lead-based, high-permittivity dielectric layer makes it possible to restrain the diffusion of the lead component from the lead-based dielectric layer into the light-emitting layer and prevent the excessive lead component from having an adverse influence on the light-emitting layer.

The influence of the addition of this non-lead-based dielectric layer on the relative permittivity of the dielectric layer is now explained. Here let e3 and e4 represent the relative permittivities of the lead-based dielectric layer and non-lead-based dielectric layer, respectively, and d3 and d4 stand for the total thicknesses of the respective layers. Then, the effective relative permittivity e5 of the entire dielectric layer arrangement comprising the lead-based dielectric layer and non-lead-based dielectric layer is given by $$e5=e3\times 1/[1+(e3/e4)\times(d4/d3)] \quad (6)$$

In consideration of the relations between the relative permittivities of the aforesaid dielectric and light-emitting layers and the effective voltage applied to the light-emitting layer, the decrease in the effective relative permittivity of the composite lead-based dielectric/non-lead-based dielectric layer associated with the addition of the non-lead-based dielectric layer must be reduced as much as possible. Preferably, the relative permittivity of the composite layer should be at least 90%, and especially at least 95%, of that of a single dielectric layer. From expression (6), it is thus found that $$\text{for at least 90\%, } e3/d3 \geqq 9\times e4/d4 \quad (7)$$

$$\text{for at least 95\%, } e3/d3 \geqq 19\times e4/d4 \quad (8)$$

For instance, if the relative permittivity and thickness of the dielectric layer are assumed to be 1,000 and 8 μm, respectively, then the ratio of relative permittivity to thickness of the non-lead-based dielectric layer should preferably be at least 1,125, and especially at least 2,375. Therefore, if the thickness of the non-lead-based dielectric layer is assumed to be 0.2 μm and 0.4 μm, then the relative permittivity should be 225 to 475 or greater and 450 to 950 or greater, respectively.

For the purpose of preventing diffusion of lead, the thickness of the non-lead-based dielectric layer should preferably be as large as possible. According to the inventor's experimental studies, the thickness of the non-lead-based dielectric layer should be preferably more than 0.2 μm, more preferably at least 0.3 μm, and most preferably at least 0.4 μm. If no problem arises in conjunction with the decrease in the effective relative permittivity, then the non-lead-based dielectric layer may have a much larger thickness.

Even when the thickness of the non-lead-based dielectric layer is 0.2 μm or less, some effect on prevention of the diffusion of lead may be obtained. However, any satisfactory effect on prevention of the diffusion of lead is hardly obtained because of minute surface defects in the lead-based dielectric layer or the surface roughness thereof, or the local surface roughness of the non-lead-based dielectric layer due to the deposition of dust or the like ascribable to fabrication steps. This may otherwise result in a local decrease or deterioration in the luminance of the light-emitting layer due to the local diffusion of the lead component.

For this reason, the non-lead-based dielectric layer should preferably be as thick as possible and the relative permittivity required for the non-lead-based dielectric layer should evidently be preferably at least 50% of, and more preferably equivalent to, that of the lead-based dielectric layer. Accordingly, and in consideration of the fact that the relative permittivity necessary for the aforesaid dielectric layer should be at least 50, preferably at least 200, and more preferably at least 450, the relative permittivity necessary for the non-lead-based dielectric layer should be at least 25, preferably at least 100, and more preferably at least 200.

As an example, consider the case where a 0.4 μm thick $Si_3N_4$ film having a relative permittivity of about 7 is formed in combination with a dielectric layer having a relative permittivity of 1,000 and a thickness of 8 μm. From expression (6), the effective relative permittivity is then found to be 122. Even when a 0.4 μm thick $Ta_2O_5$ film having a relative permittivity of about 25 is formed, the resultant effective relative permittivity becomes as low as 333. As a result, the effective voltage applied to the light-emitting layer drops largely. For this reason, the use of such a non-lead-based dielectric layer causes EL device drive voltage to become too high to obtain practical utility.

When a high-permittivity material, e.g., a $TiO_2$ film having a relative permittivity of about 80 is formed at a thickness of 0.4 μm, on the other hand, a very high effective permittivity of 615 is obtained. If a substance having a relative permittivity of 200 is used, then an effective relative permittivity as high as 800 is obtained. The use of a substance having a relative permittivity of 500 makes it possible to achieve an effective relative permittivity of 910, which is substantially equivalent to that in the absence of any non-lead-based dielectric layer.

Perovskite structure dielectric materials such as $BaTiO_3$, $SrTiO_3$, $CaTiO_3$ and $BaSnO_3$ and their solid solutions are preferred for non-lead-based, high-permittivity dielectric materials having a relative permittivity of 100 to 1,000 or greater, which exceeds the permittivity of $TiO_2$ which is about 80.

Also useful as the non-lead-based, high-permittivity dielectric material are tungsten bronze type dielectric materials. The tungsten bronze type dielectric materials are generally represented by the chemical formula: $A_xB_5O_{15}$ wherein A and B each are cations. Preferably, A is at least one element selected from among Mg, Ca, Ba, Sr, rare earth elements, and Cd; and B is at least one element selected from among Ti, Zr, Ta, Nb, Mo, W, Fe and Ni. Illustrative examples are tungsten bronze type oxides such as SBN (=$(Sr_{1-x}Ba_x)$ $Nb_2O_6$), $SrNb_2O_6$ and $Ba_3Nb_{10}O_{28}$.

By use of the non-lead-based, high-permittivity dielectric layer, it is thus possible to easily achieve the effect of the invention on prevention of the diffusion of the lead component into the light-emitting layer while the effective relative permittivity decrease is minimized.

In this connection, the inventor's studies have revealed that when such a non-lead-based dielectric layer, especially a perovskite structure material, is used, it is of importance that its composition is such that the ratio of A site atoms to B site atoms in the perovskite structure is at least 1.

To be more specific, all perovskite structure non-lead-based dielectric materials as mentioned above may crystallographically contain lead ions at the A site. Taking a $BaTiO_3$ composition as an example, consider the case where the starting composition for the formation of a $BaTiO_3$ layer is such that Ba that is the A site atom is deficient with respect to Ti that is the B site atom, as expressed by $Ba_{1-x}TiO_{3-x}$. Since an excessive lead component exists in the lead-based dielectric layer forming the $BaTiO_3$ layer, the Ba deficient site in the $BaTiO_3$ is easily replaced by the excessive lead component, yielding a $(Ba_{1-x}Pb_x)TiO_3$ layer. When a light-emitting layer is formed on the $BaTiO_3$ layer in such a state, no sufficient effect on prevention of the diffusion of lead is obtained because the light-emitting layer comes in direct contact with the lead component.

It is thus preferred that the composition of the perovskite structure non-lead-based dielectric layer should at least be shifted to an A site excess side from the stoichiometric composition. As can be inferred from this explanation, even when the composition of the perovskite structure non-lead-based dielectric material is shifted to an A site excess side from the stoichiometric composition, there is a significant if remote possibility that the portion of the non-lead-based dielectric layer in the vicinity of the interface with respect to the lead-based dielectric layer may react with a part of the lead component, because the perovskite structure non-lead-based dielectric material may crystallographically be substituted by the lead component. For this reason, the non-lead-based dielectric layer should preferably have a certain or greater thickness. According to the inventor's experimental studies, this thickness should be 0.1 $\mu$m or greater, and preferably greater than 0.2 $\mu$m.

Like the perovskite dielectric materials, in the case of tungsten bronze type dielectric materials as typified by SBN: $(Sr_{1-x}Ba_x)Nb_2O_6$, whose composition is represented by the chemical formula: $A_xB_xO_{15}$, wherein the A ion can be replaced by Pb, it is desired that the cation at the A site be present in an amount of equal to or more than the stoichiometry.

For the formation of the non-lead-based dielectric layer while its composition is under full control, it is preferable to make use of a sputtering process or the solution coating-and-firing process because the composition can be well controlled.

It is preferable to form the non-lead-based dielectric layer using the sputtering process, because a thin film having the same composition as the target composition can be easily formed, and a closely packed thin film having higher density and expected to produce a more enhanced effect on prevention of the diffusion of the lead component can be easily formed as well.

The solution coating-and-firing process is more preferred for the reasons that it is possible to form a dielectric layer whose composition is more strictly controlled by control of the preparation ratio of the precursor solution as compared with the sputtering process; it is possible to allow the non-lead-based dielectric layer itself to have a defect healing effect that is the feature of the solution coating-and-firing process as will be described later; the solution coating-and-firing process is free from any surface roughness problem due to enhanced asperities on a substrate, which occur when a thick layer is formed by the sputtering process on the substrate; a thick layer can be easily formed; and the non-lead-based dielectric layer can be formed without recourse to any costly film formation equipment, viz., with equipment and steps similar to those for the lead-based dielectric layer.

The results of close studies by the inventor show that the aforesaid advantages are particularly outstanding under the following conditions.

The first condition is to provide the dielectric layer in the form of a composite structure comprising lead-based dielectric layers and a non-lead-based, high-permittivity dielectric layer(s), wherein at least the lead-based dielectric layers are formed by repeating the solution coating-and-firing process plural times, and at least the uppermost surface layer of the composite structure is made up of the non-lead-based, high-permittivity dielectric layer. With this structure, it is possible to prevent the excessive lead component of the lead-based dielectric layer from having an adverse influence on the light-emitting layer, as mentioned above.

The second condition is to construct the non-lead-based dielectric layer of a high-permittivity film, and most preferably a non-lead-based composition perovskite structure dielectric material which can easily have a relative permittivity of at least 100. By constructing the non-lead-based dielectric layer of such a high-permittivity film, it is possible to prevent a decrease in the effective relative permittivity of the composite dielectric layer due to the inclusion of the non-lead-based dielectric layer. Most preferably, a perovskite structure, non-lead-based, high-permittivity dielectric material is used as the high-permittivity film, whereby the decrease in the effective relative permittivity of the dielectric layer can be minimized and satisfactory lead diffusion preventing effect is achievable. Especially when the composition of the perovskite structure, non-lead-based, high-permittivity layer is used, it is important to shift the composition from the stoichiometric ratio into an A site excess side. This makes it possible to achieve a perfect effect on prevention of the diffusion of the lead component into the light-emitting layer.

The third condition is to form the non-lead-based, high-permittivity dielectric layer using the sputtering process or the solution coating-and-firing process. With the sputtering process, it is possible to form a high-density, closely packed, non-lead-based, high-permittivity dielectric layer while its composition is easily controlled. With the solution coating-and-firing process, it is possible to easily form a thicker, non-lead-based, high-permittivity dielectric layer free from any surface asperity problem while its composition is placed under more severe control. In addition, the effect of healing defects occurring on each sub-layer due to dust or the like—which is the feature of the solution coating-and-firing process—is also expectable during the formation of the non-lead-based, high-permittivity dielectric layer. By forming both the lead-based dielectric layer and the non-lead-based, high-permittivity dielectric layer by repeating the solution coating-and-firing process a total of three or more times, it is thus possible to shirk a dielectric breakdown or other problem at a locally dielectric strength decreased site occurring through the aforesaid defects.

Also, by setting the thickness of the dielectric layer to be at least 4 times the thickness of the lower electrode layer, the coverage at pattern edges resulting from patterning of the lower electrode layer and the surface flatness of the dielectric layer can be fully improved.

The fourth condition is to limit the thickness of the multilayer dielectric layer to 4 $\mu$m to 16 $\mu$m inclusive. The inventor's studies have revealed that the particle size of dust, etc. occurring at processing steps in an ordinary clean room, for the most part, is 0.1 to 2 $\mu$m, especially about 1 $\mu$m, and that by bringing the average thickness of the multilayer dielectric layer to at least 4 $\mu$m and especially at least 6 $\mu$m, it is possible to bring the dielectric strength of a defective portion of the dielectric layer due to dust or other defects to at least ⅔ of the average dielectric strength.

A thickness exceeding 16 $\mu$m results in cost increases because the number of repetition of the solution coating-and-firing process becomes too large. In addition, as the thickness of the dielectric layer increases, it is required to increase the relative permittivity perse of the dielectric layer, as can be understood from expressions (3) to (5). At a thickness of 16 $\mu$m or greater as an example, the required permittivity is at least 160, preferably at least 640, and more preferably at least 1,440. However, much technical difficulty is generally encountered in forming a dielectric layer having a relative permittivity of 1,500 or greater, using the solution coating-and-firing process. In the invention, on the other hand, it is easy to form a defect-free dielectric layer of high dielectric strength, and so it is unnecessary to form a dielectric layer having a thickness exceeding 16 $\mu$m. For these reasons, the upper limit to the thickness is 16 $\mu$m or less, and preferably 12 $\mu$m or less.

If the thickness of the dielectric layer is at least four times as large as the thickness of the lower electrode layer, it is also possible to make sufficient improvements in the coverage capability for pattern edges occurring by the patterning of the lower electrode layer and the surface flatness of the dielectric layer.

The only one requirement for the stack arrangement of the lead-based dielectric layer and non-lead-based, high-permittivity dielectric layer in the invention is that the uppermost surface of the arrangement be composed of the non-lead-based, high-permittivity dielectric layer. These layers may also be alternately stacked one upon another so that the uppermost surface layer is a non-lead-based, high-permittivity dielectric layer. With such a stack arrangement, the diffusion of the excessive lead component in the lead-based dielectric layers is effectively prevented by the alternately stacked non-lead-based, high-permittivity dialectic layers, so that the effect of the uppermost non-lead-based, high-permittivity dielectric layer on prevention of the diffusion of the lead component is much more enhanced. This stack arrangement is advantageous for the non-lead-based, high-permittivity dielectric layer formed by the sputtering process in particular; it is effective to avoid a noticeable surface asperity problem associated with the sputtering process, which arises when a thick layer is formed thereby.

Figure 5:
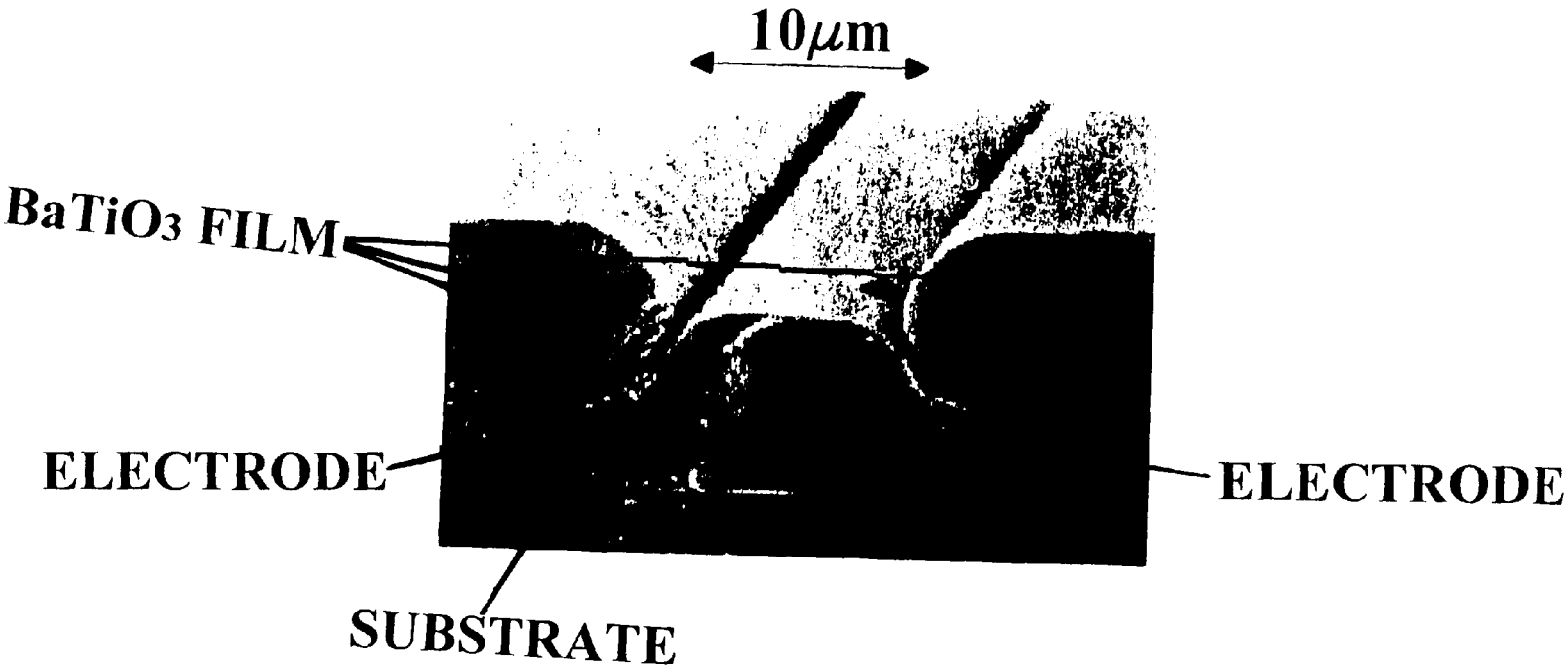
FIG. 5 PRIOR ART
FIG. 5 is an electron microscope photograph illustrative in section of a prior art thin-film EL device.

For a better understanding of the advantages of the invention, aside from the multilayer dielectric layer including the lead-based dielectric layers formed by repeating the solution coating-and-firing process plural times and the non-lead-based, high-permittivity dielectric layer stacked at least as the uppermost surface layer according to the invention, a dielectric layer formed by the sputtering process is now explained with reference to an electron microscope photograph. FIG. 5 is an electron microscope photograph of the case where an 8 $\mu$m thick $BaTiO_3$ thin film is formed by sputtering on a substrate on which a 3 $\mu$m thick lower electrode layer has been formed and patterned. As can be seen from FIG. 5, when the dielectric layer is provided by sputtering, the surface of the dielectric film is formed with steps in enlarged conformity to steps on the substrate and, hence, there are noticeable asperities and overhangs on the surface thereof. A similar asperity phenomenon on the surface of the dielectric layer is also found when the dielectric layer is formed by an evaporation process, not by the sputtering process. A functional thin film like an EL light-emitting layer cannot possibly be formed and used on such a dielectric layer. Defects inevitably associated with a dielectric layer formed by a conventional process such as a sputtering process and caused by steps on the lower electrode layer, dust or the like can be perfectly covered up by repeating the solution coating-and-firing process plural times according to the invention, whereby a dielectric layer having a flattened surface can be obtained.

For the light-emitting layer material, known materials such as the aforesaid Mn-doped ZnS may be used although the invention is not particularly limited thereto. Among these, SrS:Ce and barium thioaluminate phosphor serving as blue light emitting substance are particularly preferred because improved properties are achievable. No particular limitation is imposed on the thickness of the light-emitting layer; however, too large a thickness leads to a driving voltage rise whereas too small a thickness causes a light emission luminance drop. By way of example, the light-emitting layer preferably has a thickness of the order of 100 to 2,000 nm although varying with the light-emitting material used.

The light-emitting layer may be formed by vapor phase deposition processes, among which physical vapor phase deposition processes such as sputtering and evaporation and chemical vapor phase deposition processes such as CVD are preferred. Especially when the light-emitting layer is formed of the aforesaid SrS:Ce, it is possible to obtain a light-emitting layer of high purity by making use of an electron beam evaporation process in a $H_2S$ atmosphere while the substrate is held at a temperature of 500° C. to 600° C. during film formation.

After the light-emitting is formed, it should preferably be treated by heating. This heat treatment may be carried out after the electrode layer, dielectric layer and light-emitting layer are stacked on the substrate in this order or, alternatively, carried out (by cap annealing) after the electrode layer, dielectric layer, light-emitting layer, insulator layer, and optionally further electrode layer are stacked on the substrate in this order. Although depending on the light-emitting layer, the heat treatment for SrS:Ce should be carried out at a temperature of 500° C. to 600° C. or higher to the firing temperature of the dielectric layer for 10 to 600 minutes. For the heat treatment atmosphere, Ar is preferred.

For the formation of a light-emitting layer taking full advantage of SrS:Ce, barium thioaluminate phosphor or the like, film formation should be carried out at a high temperature of 500° C. or higher in a vacuum or reducing atmosphere, and the high-temperature thermal treatment step should then be carried out under atmospheric pressure. With the prior art, problems such as the reaction of the lead component in the dielectric layer with the light-emitting layer and the diffusion of lead are unavoidable. By contrast, the thin-film EL device of the invention can fully prevent the adverse influences of the lead component on the light-emitting layer, and so has a great advantage over the prior art.

The thin-film insulator layer 17 and/or 15 may be omitted as previously indicated although the provision of these insulator layers is preferred.

The thickness of the thin-film insulator layer may be reduced because the thin-film insulator layer functions for the primary purpose of adjusting the electron state at the interface between the light-emitting layer and the dielectric layer for enabling stable and efficient injection of electrons into the light-emitting layer, and establishing the electron states symmetrically on opposite sides of the light-emitting layer for ameliorating the positive-negative symmetry of light emission properties upon ac driving and because the dielectric strength maintaining function, that is the role of the dielectric layer formed by the solution coating-and-firing process, is negligible.

The thin-film insulator layer should have a resistivity of at least $10^8$ Ω·cm, and preferably about $10^{10}$ to $10^{18}$ Ω·cm, and be preferably made up of a material having a relatively high relative permittivity of $\epsilon=3$ or greater. The thin-film insulator layer, for instance, may be made up of silicon oxide ($SiO_2$), silicon nitride (SiN), tantalum oxide ($Ta_2O_5$), yttrium oxide ($Y_2O_3$), zirconia ($ZrO_2$), silicon oxynitride (SiON), and alumina ($Al_2O_3$). The thin-film insulator layer may be formed by sputtering and evaporation processes. Also it is preferred that the thin-film insulator layer have a thickness of 50 to 1,000 nm, and especially about 50 to 200 nm.

The transparent electrode layer may be made up of oxide conductive materials such as ITO, $SnO_2$ (Nesa film) and ZnO-Al of 0.2 μm to 1 μm in thickness, and formed by known techniques such as sputtering as well as evaporation techniques.

While the thin-film EL device has been described as having a single light-emitting layer, it is appreciated that the thin-film EL device of the invention is not limited to such construction. For instance, a plurality of light-emitting layers may be stacked in the thickness direction or, alternatively, a matrix combination of different types of light-emitting layers (pixels) may be arranged on a plane.

While the thin-film EL device has been described as extracting the light emission of the light-emitting layer from the upper ITO electrode side, the thin-film EL device of the invention is not limited to such construction. Instead, the light emission of the light-emitting layer may be extracted from the insulating substrate side. In this case, light transparent substrates such as heat resistant glass are used as the insulating substrate and transparent electrodes of ITO or the like may be used as the lower electrode.

The thin-film EL device of the invention may be easily identified by observation under an electron microscope. That is, it is seen that the dielectric layer formed by the repetition of the solution coating-and-firing process of the invention is not only in a multilayer form unlike a dielectric layer formed by other processes but is also different in quality therefrom. In addition, this dielectric layer has another feature of very excellent surface smoothness.

As already described, the thin-film EL device of the invention allows high-performance, high-definition displays having a high luminance and long-term reliability of luminance to be easily set up because the dielectric layer, on which the light-emitting layer is to be stacked, is of very excellent surface smoothness and high dielectric strength, and is free form any defect as well, and because damage to the light-emitting layer by the excessive lead component of the dielectric layer—which has so far been a problem with the prior art—can be prevented altogether. Furthermore, the thin-film EL device of the invention is so easy to fabricate that fabrication costs can be cut down.

EXAMPLE

Examples are given below for further illustrating the present invention.

Example 1

A1 μm thick Au thin film with trace additives added thereto was formed by sputtering on a surface polished alumina substrate of 99.6% purity, and heat treated at 700° C. for stabilization. Using a photoetching process, this Au thin film was patterned in a stripe pattern comprising a number of stripes having a width of 300 μm and a space of 30 μm.

A lead-based dielectric layer, i.e., a PZT dielectric layer was formed on the substrate using the solution coating-and-firing process. The dielectric layer was formed by repeating predetermined times the solution coating-and-firing process wherein a sol-gel solution prepared as mentioned below was spin coated as a PZT precursor solution on the substrate and fired at 700° C. for 15 minutes.

To prepare a basic sol-gel solution, 8.49 grams of lead acetate trihydrate and 4.17 grams of 1,3-propanediol were heated under agitation for about 2 hours to obtain a transparent solution. Separately, 3.70 grams of a 70 wt % 1-propanol solution of zirconium n-propoxide and 1.58 grams of acetylacetone were heated under agitation in a dry nitrogen atmosphere for 30 minutes to obtain a solution, to which were added 3.14 grams of a 75 wt % 2-propanol solution of titanium diisopropoxide bisacetyl acetonate and 2.32 grams of 1,3-propanediol, which was then heated under agitation for a further 2 hours. These two solutions were mixed together at 800° C., and the resultant mixture was heated under agitation for 2 hours in a dry nitrogen atmosphere to prepare a brown transparent solution. This solution, after held at 130° C. for a few minutes to remove by-products therefrom, was heated under agitation for a further three hours, thereby preparing a PZT precursor solution.

The viscosity of the sol-gel solution was regulated by dilution with n-propanol. By control of the spin coating conditions and the viscosity of the sol-gel solution, the thickness of each sub-layer in the dielectric layer was regulated to 0.7 μm. The PZT layer formed under this condition contained the lead component in an about 10% excess of the stoichiometric composition.

By repeating the spin coating and firing of the aforesaid sol-gel solution as the PZT precursor solution ten times, a lead-based dielectric layer of 7 μm in thickness was formed. This PZT film was found to have a relative permittivity of 600.

Formed on the lead-based dielectric layer as the non-lead-based, high-permittivity dielectric layer were a $BaTiO_3$ film formed by the solution coating-and-firing process, and a $BaTiO_3$ film, an $SrTiO_3$ film, and a $TiO_2$ film each formed by the sputtering process. In this way, samples were obtained. For the purpose of comparison, a sample was prepared without recourse of any non-lead-based, high-permittivity dielectric layer.

The $BaTiO_3$ thin film was formed using a magnetron sputtering system operating on a $BaTiO_3$ ceramic material as a target and at an Ar gas pressure of 4 Pa, a radio frequency of 13.56 MHz and an electrode density of 2 W/cm$^2$. The film deposition rate was about 5 nm/min., and a thickness of 50 nm to 400 nm was obtained by control of the sputtering time. The thus formed $BaTiO_3$ thin film was in an amorphous state, and the heat treatment of this film at 700° C. gave a relative permittivity of 500. By X-ray diffractometry, the heat-treated $BaTiO_3$ thin film was identified to have a perovskite structure. The composition of this $BaTiO_3$ thin film contained Ba in a 5% excess of the stoichiometric composition.

The $SrTiO_3$ thin film was formed using a magnetron sputtering system operating on an $SrTiO_3$ ceramic material as a target and at an Ar gas pressure of 4 Pa, a radio frequency of 13.56 MHz and an electrode density of 2 W/cm$^2$. The film deposition rate was about 4 nm/min., and a thickness of 400 nm was obtained by control of the sputtering time. The thus formed $SrTiO_3$ thin film was in an amorphous state, and the heat treatment of this film at 700° C. gave a relative permittivity of 250. By X-ray diffractometry, the $SrTiO_3$ thin film heat treated at a temperature higher than 500° C. was identified to have a perovskite structure. The composition of this $SrTiO_3$ thin film contained Sr in a 3% excess of the stoichiometric composition.

The $TiO_2$ thin film was formed using a magnetron sputtering system operating on a $TiO_2$ ceramic material as a target and at an Ar gas pressure of 1 Pa, a radio frequency of 13.56 MHz and an electrode density of 2 W/cm$^2$. The film deposition rate was about 2 nm/min., and a thickness of 400 nm was obtained by control of the sputtering time. The heat treatment of this film at 600° C. gave a relative permittivity of 76.

The $BaTiO_3$ film by the solution coating-and-firing process was formed by repeating predetermined times a process wherein a sol-gel solution prepared as mentioned below was spin coated as a $BaTiO_3$ precursor solution on a substrate, then heated stepwise to a maximum temperature of 700° C. at an increment of 200° C., and finally fired at the maximum temperature for 10 minutes.

To prepare the $BaTiO_3$ precursor solution, PVP (polyvinyl pyrrolidone) having a molecular weight of 630,000 was completely dissolved in 2-propanol, and acetic acid and titanium tetraisopropoxide were added to the resulting solution under agitation, thereby obtaining a transparent solution. A mixed solution of pure water and barium acetate was added dropwise to this transparent solution under agitation. While stirring was continued in this state, the resultant solution was aged for a predetermined time. The composition ratio for the respective starting materials was barium acetate: titanium tetraisopropoxide:PVP:acetic acid:pure water:2-propanol=1:1:0.5:9:20:20. In this way, the $BaTiO_3$ precursor solution was obtained.

The coating and firing of the aforesaid $BaTiO_3$ precursor solution was carried out once, and twice, thereby obtaining a $BaTiO_3$ dielectric layer of 0.5 $\mu$m, and 1.0 $\mu$m in thickness, respectively. This film had a relative permittivity of 380 and a composition in coincidence with the stoichiometric composition.

On the substrate having the lead-based dielectric layer and non-lead-based, high-permittivity dielectric layer stacked thereon, a light-emitting layer of SrS:Ce was formed by an electron beam evaporation process while the substrate was held at a temperature of 500° C. in a $H_2S$ atmosphere for film formation. The light-emitting layer was then heat treated at 600° C. for 30 minutes in a vacuum.

Then, an $Si_3N_4$ thin film as an insulator layer and an ITO thin film as an upper electrode layer were successively formed by sputtering, thereby obtaining a thin-film EL device. In this case, the upper electrode layer of ITO thin film was patterned in stripes having a width of 1 mm, using a metal mask during film deposition. The light emission properties of the obtained device structure were measured with the application at a pulse width of 50 $\mu$S and 1 kHz of an electric field at which the light emission luminance was saturated while electrodes were led out of the lower electrode and upper transparent electrode.

The properties to evaluate were light emission threshold voltage, saturated luminance, and deterioration in the luminance reached after 100 hour-continuous light emission.

TABLE 1

| Sample | Pb-based dielectric layer | Film thickness ($\mu$m) | Non-Pb, high permittivity dielectric layer | Film thickness ($\mu$m) | Light-emitting voltage (V) | Ultimate luminance (cd/m$^2$) | Deterioration (%) | Remarks |
|---|---|---|---|---|---|---|---|---|
| 1 | PZT | 7 | — | — | 170 | 500 | 50 | Comparison |
| 2 | PZT | 7 | SP-$BaTiO_3$ | 0.05 | 150 | 550 | 40 | Invention |
| 3 | PZT | 7 | SP-$BaTiO_3$ | 0.1 | 145 | 890 | 14 | Invention |
| 4 | PZT | 7 | SP-$BaTiO_3$ | 0.2 | 140 | 1120 | 5 | Invention |
| 5 | PZT | 7 | SP-$BaTiO_3$ | 0.4 | 142 | 1230 | 5 | Invention |
| 6 | PZT | 7 | SP-$SrTiO_3$ | 0.4 | 144 | 1200 | 6 | Invention |
| 7 | PZT | 7 | SP-$TiO_2$ | 0.4 | 150 | 1050 | 20 | Invention |
| 8 | PZT | 7 | SOL-$BaTiO_3$ | 0.5 | 143 | 1200 | 5 | Invention |
| 9 | PZT | 7 | SOL-$BaTiO_3$ | 1.0 | 146 | 1220 | 4 | Invention |

In Table 1, SP and SOL mean spin coating and sol-gel processes, respectively.

As a result, the comparative example free from the non-lead-based, high-permittivity dielectric layer showed a luminance deterioration of as large as 50%, and the samples containing the $BaTiO_3$ layer formed by the sputtering process according to the invention had an ultimate luminance of about 1,200 cd at a thickness of 0.2 μm or greater and a light emission threshold voltage of about 140 V, with only limited luminance deterioration. At less than 0.1 μm, on the other hand, the light emission threshold voltage increased with a decreasing ultimate luminance, resulting in further considerable luminance deterioration. The $SrTiO_3$ layer gave much the same properties as in the case of the $BaTiO_3$ layer having the same thickness, although there was a slight light emission threshold voltage increase. The $BaTiO_3$ layer formed by the solution coating-and-firing process, too, gave much the same properties as in the case of the dielectric layers obtained by sputtering, although there was a slight light emission threshold increase.

The $TiO_2$ film was higher in threshold voltage and lower in luminance than the $BaTiO_3$ film having the same thickness, with some remarkable luminance deterioration. The $Al_2O_3$ film, when 0.1 μm thick, suffered a threshold voltage increase, a substantial luminance drop, and a remarkable luminance deterioration, and when 0.4 μm thick, suffered a substantial threshold voltage increase, leading to dielectric breakdown before reaching the ultimate luminance.

In the comparative structure composed only of PZT, there were light emission threshold voltage increases as well as luminance decreases with considerable luminance deterioration. In addition, a dielectric breakdown was often found at an applied voltage in the vicinity of the ultimate luminance.

As can be seen from these results, the structure using the non-lead-based, high-permittivity perovskite layer as the non-lead-based, high-permittivity layer started to show its effect at a thickness of 0.1 μm and greater, and exhibited a remarkable light emission luminance increase, a significant threshold voltage drop, and reliability improvements especially at 0.2 μm or greater.

This reveals that the diffusion of the lead component in the lead-based dielectric layer into the light-emitting layer is effectively prevented.

The $TiO_2$ layer was lower in saturated luminance, higher in light emission threshold voltage and more significant in luminance deterioration than, the perovskite layer, although it was found to have a certain effect as a reaction preventive layer. This is presumably because the $TiO_2$ film was partly placed in a $PbTiO_3$ state through the reaction with the excessive lead in the PZT layer, and so could not perfectly function as a reaction preventive layer.

Example 2

As in Example 1, a lead-based dielectric layer of 7 μm thick was formed on the substrate having the lower electrode formed thereon, by repeating 3.0 times the process of spin coating and firing the PZT precursor solution. This PZT film had a relative permittivity of 600.

Formed on the lead-based dielectric layer as the non-lead-based, high-permittivity dielectric layer were a $(Sr_{0.65}Ba_{0.33})Nb_2O_6$ thin film formed by the sputtering process, and a $BaTiO_3$ film and a $TiO_2$ film formed by the same process as in Example 1. For the purpose of comparison, a sample was prepared without recourse of any non-lead-based, high-permittivity dielectric layer. A $BaTiO_3$ a film deficient of A site atoms was also formed.

The $BaTiO_3$ thin film deficient of A site atoms was formed magnetron sputtering system operating on an $BaTiO_3$ ceramic material as a target and at an Ar gas pressure of 0.3 Pa, a radio frequency of 13.56 MHz and an electrode density of 2 W/cm$^2$. The film deposition rate was about 6 nm/min., and a thickness of 400 nm was obtained by control of the sputtering time. The thus formed $BaTiO_3$ thin film was in an amorphous state, and the heat treatment of this film at 700° C. gave a relative permittivity of 230. By X-ray diffractometry, the heat treated $BaTiO_3$ thin film was identified to have a perovskite structure. The composition of this $BaTiO_3$ thin film contained Ba in a 10% deficiency of the stoichiometric composition.

The $(Sr_{0.65}Ba_{0.35})Nb_2O_6$ thin film was formed using a magnetron sputtering system operating on a $(Sr_{0.65}Ba_{0.35})Nb_2O_6$ ceramic material as a target and at an Ar gas pressure of 4 Pa, a radio frequency of 13.56 Mz and an electrode density of 2 W/cm$^2$. The substrate temperature was 750° C. during film deposition. The film deposition rate was about 6 nm/min., and a thickness of 400 nm was obtained by control of the sputtering time. The thus formed $(Sr_{0.65}Ba_{0.35})Nb_2O_6$ thin film had been crystallized in the tungsten bronze structure. To improve dielectric properties. this film was heat treated at 750° C. in air, reaching a relative permittivity of 200. The composition of this film was stoichiometric.

Next, a barium thioaluminate phosphor layer as a blue light emitting substance was formed on these dielectric substrates. In order that the phosphor layer function for an RL device to emit light in a stable manner, a composite structure of $Al_2O_3$ film (50 nm)/ZnS film (200 nm)/barium thioaluminate phosphor thin-film (300 nm)/ZnS film (200 nm)/$Al_2O_3$ film (50 nm) was fabricated. In this structure, the $Al_2O_3$ film functions as a cap layer for controlling the quantity of oxygen introduced into the phosphor thin-film during annealing in an oxidizing atmosphere, and the ZnS film which has been preformed to be excessive or deficient of sulfur functions as a sulfur controlling layer for optimizing the quantity of sulfur in the phosphor thin-film during annealing. After the device is fabricated, the $Al_2O_3$ film functions mainly as an electron injecting layer for the light-emitting layer rather than the functions of an insulating film or dielectric layer. The ZnS layer functions as an injection enhancement layer for accelerating injected electrons as well.

In depositing the barium thioaluminate phosphor film, a multi-source evaporation process using two electron guns was employed. Disposed in a vacuum chamber filled with $H_2S$ were an EB source Containing BaS powder having 5 at % Eu added and another ED source containing $Al_2S_3$ powder. By simultaneously evaporating the reactants from the ED sources, a $BaAl_2O_3S$:Eu layer was formed on a rotating substrate heated at 500° C. The evaporation rates of the respective sources were adjusted so that $BaAl_2O_3S$:Eu was deposited at a rate of 1 nm/sec. $H_2S$ gas was fed at 20 SCCM.

After deposition, the thin film was annealed in air at 750° C. for 20 minutes, yielding a phosphor thin-film of 300 nm thick.

A $BaAl_2O_3S$:Eu thin-film was formed on a Si substrate as a monitor and its composition examined by x-ray fluorescence analysis, finding an atomic ratio of Ba:Al:0:S:Eu 7.41:19.20:60.18:13.0:0.32.

An ITO transparent electrode of 200 nm thick was formed on the structure obtained above by an RF magnetron sputtering process using an ITO oxide target and at a substrate temperature of 250° C., completing an EL device.

The light emission properties of this EL device were evaluated. While electrodes were led out of the ITO upper electrode and the Pd upper electrode of the resulting structure, a bipolar electric field of 50 $\mu$S in pulse width was applied at 1 kHz. The results are shown in Table 2.

TABLE 2

| Sample | Pb-based dielectric layer | Film thickness ($\mu$m) | Non-Pb, high permittivity dielectric layer | Film thickness ($\mu$m) | Luminance (cd/m$^2$) | Remarks |
|---|---|---|---|---|---|---|
| 10 | PZT | 7 | SP-$BaTiO_3$ | 0.1 | 90 | Invention |
| 11 | PZT | 7 | SP-$BaTiO_3$ | 0.2 | 230 | Invention |
| 12 | PZT | 7 | SP-$BaTiO_3$ | 0.3 | 650 | Invention |
| 13 | PZT | 7 | SP-$BaTiO_3$ | 0.4 | 1020 | Invention |
| 14 | PZT | 7 | SP-SBN | 0.4 | 550 | Invention |
| 15 | PZT | 7 | SP-$TiO_3$ | 0.4 | 600 | Invention |
| 16 | PZT | 7 | SP-$TiO_2$ | 0.2 | 110 | Invention |
| 17 | PZT | 7 | Ba-defficient $BaTiO_3$ | 0.4 | 780 | Invention |
| 18 | PZT | 7 | — | — | 1 | Comparison |

In Table 2, SP and SOL mean spin coating and sol-gel processes, respectively.

As is evident from Table 2, the EL devices using the $BaTiO_3$ non-lead-based dielectric layer according to the invention produce a very high luminance, specifically a luminance of 650 cd/m$^2$ and 1,020 cd/m$^2$ at a film thickness of 300 run and 400 nm, respectively. The devices produce a reduced luminance of 230 cd/m$^2$ and 90 cd/m$^2$ at a film thickness of 200 nm and 100 nm, respectively, but still a significant effect is ascertainable.

The device using the SBN thin-film according to the invention produces a lower luminance of 550 cd/m$^2$ than the use of $BaTiO_3$ dielectric layers, but still a significant effect is ascertainable.

The devices in which the $TiO_2$ thin film is formed produce a luminance of 110 cd/m$^2$ at a film thickness of 200 nm, but a relatively high luminance of 600 cd/m$^2$ at a film thickness of 400 nm, which is reduced as compared with the $BaTiO_3$ samples. This is presumably because the $TiO_3$ thin film was partly placed in a $PbTiO_3$ state through the reaction with the excessive lead in the PZT layer, and so could not perfectly function as a reaction preventive layer, as in Example 1, although some effect as the reaction preventive layer was perceivable, and because the permittivity was as low as about 80, as compared with other non-lead-based dielectric layers, so that no sufficient light emission was available.

In contrast, the EL device, which was fabricated as the comparative example under the same conditions except that the non-lead-based dielectric layer was omitted, produced a luminance of 1 cd/m$^2$, which was substantially nil as compared with the use of $BaTiO_3$ non-lead-based dielectric layers. This reveals the advantages of the EL devices having a non-lead-based dielectric layer stacked according to the invention.

When the $BaTiO_3$ film deficient of 10% Ba was used, the device produced a high luminance as demonstrated by a luminance of 780 cd/m$^2$, which was low as compared with the $BaTiO_3$ thin film of the same thickness and free of Ba deficiency. As in the case of $TiO_2$ thin film, this is presumably because the Ba-deficient $BaTiO_3$ thin film reacts with excessive lead in the PZT layer and becomes less effective as a reaction preventive layer.

It is noted that the EL devices fabricated in this Example emitted blue light having CIE 1931 chromaticity coordinates (0.1295, 0.1357) and the peak wavelength of emission spectra was 471 nm, indicating highly excellent blue light emission.

The samples of Examples and Comparative Example were examined for impurities in a film thickness direction by Auger spectroscopy. In Comparative Example, Pb element was detected from the phosphor thin-film region. This is presumably because Pb element in the multilayer PZT dielectric layer formed by the solution coating-and-firing process had diffused. In contrast, no Pb element was detected from the phosphor thin film region in Examples.

These results show that the luminance of EL devices is drastically improved by the effects of the invention discussed in connection with its operation, demonstrating the effectiveness of the invention.

ADVANTAGES OF THE INVENTION

The advantages of the invention can be understood from the foregoing. According to the invention, the defects occurring in the dielectric layer—which are one problem associated with the prior art—can be eliminated. In particular, a solution can be provided to problems in conjunction with the light emission luminance drops, luminance variations, and changes of light emission luminance with time of a thin-film EL device wherein the multilayer dielectric layer is constructed by the solution coating-and-firing process using a lead-based dielectric material. It is thus possible to provide, without incurring any added cost, a thin-film EL device capable of presenting displays of high quality, and a process for the fabrication of the same.

What we claim is:

1. A thin-film EL device having at least a structure comprising an electrically insulating substrate, a patterned lower electrode layer stacked on said substrate, and a dielectric layer, a light-emitting layer and an upper electrode layer stacked on said lower electrode layer, at least one of said lower electrode and said upper electrode being a transparent electrode, wherein said dielectric layer has a multilayer structure wherein a lead-based dielectric layer or layers formed by repeating a solution coating-and-firing process plural times and a non-lead-based, high-permittivity dielectric layer or layers are stacked, and an uppermost surface layer of said dielectric layer having a multilayer structure is the non-lead-based, high-permittivity dielectric layer.

2. The thin-film EL device of claim 1, wherein said lead-based dielectric layer has a thickness of 4 $\mu$m to 16 $\mu$m inclusive.

3. The thin-film EL device of claim 1, wherein said non-lead-based dielectric layer has a thickness of more than 0.2 $\mu$m.

4. The thin-film EL device of claim 1, wherein said non-lead-based, high-permittivity dielectric layer is made of a perovskite structure dielectric material.

5. The thin-film EL device of claim 1, wherein said non-lead-based, high-permittivity dielectric layer is formed by a sputtering process.

6. The thin-film EL device of claim 1, wherein said non-lead-based, high-permittivity dielectric layer is formed by the solution coating-and-firing process.

7. The thin-film EL device of claim 6, wherein said dielectric layer having a multilayer structure is formed by repeating the solution coating-and-firing process at least three times.

8. A process for fabricating a thin-film EL device of claim 1 having at least a structure comprising an electrically insulating substrate, a patterned lower electrode layer stacked on said substrate, and a dielectric layer, a light-emitting layer and an upper electrode layer stacked on said lower electrode layer, at least one of said lower electrode and said upper electrode being a transparent electrode, said process comprising the step of:

stacking a lead-based dielectric layer or layers formed by repeating a solution coating-and-firing process plural times and a non-lead-based, high-permittivity dielectric layer or layers to form a multilayer structure such that an uppermost surface layer of the dielectric layer having the multilayer structure is the non-lead-based, high-permittivity dielectric layer.

9. The thin-film EL device fabrication process of claim 8, wherein said non-lead-based, high-permittivity dielectric layer is formed by a sputtering process.

10. The thin-film EL device fabrication process of claim 8, wherein said non-lead-based, high-permittivity dielectric layer is formed by the solution coating-and-firing process.

11. The thin-film EL device fabrication process of claim 10, wherein said dielectric layer having the multilayer structure is formed by repeating the solution coating-and-firing process at least three times.

* * * * *